US008730288B2

(12) United States Patent
Miyadera

(10) Patent No.: US 8,730,288 B2
(45) **Date of Patent: *May 20, 2014**

(54) OPTICAL WRITING DEVICE, IMAGE FORMING APPARATUS, AND CORRECTION VALUE INFORMATION GENERATING METHOD

(75) Inventor: Tatsuya Miyadera, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 102 days.

This patent is subject to a terminal disclaimer.

(21) Appl. No.: 13/457,953

(22) Filed: Apr. 27, 2012

(65) Prior Publication Data

US 2012/0288291 A1 Nov. 15, 2012

(30) Foreign Application Priority Data

May 12, 2011 (JP) ..... 2011-107480

(51) Int. Cl.
*B41J 2/435* (2006.01)

(52) U.S. Cl.
USPC ..... 347/229; 347/236; 347/237; 347/246

(58) Field of Classification Search
USPC ..... 347/229, 236, 237, 246
See application file for complete search history.

(56) References Cited

U.S. PATENT DOCUMENTS

2007/0116482 A1* 5/2007 Ichikawa et al. ..... 399/49
2009/0196636 A1* 8/2009 Miyadera ..... 399/39
2011/0043592 A1* 2/2011 Kinoshita et al. ..... 347/236
2011/0255891 A1* 10/2011 Hirano ..... 399/51
2012/0056961 A1 3/2012 Kinoshita et al.
2012/0062681 A1 3/2012 Miyadera et al.
2012/0207498 A1* 8/2012 Miyadera et al. ..... 399/51

FOREIGN PATENT DOCUMENTS

| | | | |
|---|---|---|---|
| JP | 7-52447 | | 2/1995 |
| JP | 9-323443 | | 12/1997 |
| JP | 2003186278 | A * | 7/2003 |
| JP | 3644923 | | 2/2005 |
| JP | 2006-187929 | | 7/2006 |
| JP | 2007-144731 | | 6/2007 |
| JP | 2008-134313 | | 6/2008 |
| JP | 2008134313 | A * | 6/2008 |
| JP | 2010-8913 | | 1/2010 |
| JP | 2010008913 | A * | 1/2010 |

* cited by examiner

*Primary Examiner* — Sarah Al Hashimi
(74) *Attorney, Agent, or Firm* — Oblon, Spivak, McClelland, Maier & Neustadt, L.L.P.

(57) ABSTRACT

An optical writing device includes a light emission control unit configured to cause a light source to emit light based on a rotational position of a photosensitive element and pixel information making up a correction pattern to form an electrostatic latent image of the correction pattern on the photosensitive element, the correction pattern being formed across an entire circumference of the photosensitive element in a rotating direction; a reading signal acquiring unit configured to acquire reading signals resulting from reading the correction pattern, and generate, based on the reading signals, density variation information in which the rotational position and a density of the correction pattern are associated; and a correction value information generation control unit configured to generate information about correction to an amount of light emitted by the light source based on the density of the correction pattern to generate correction value information.

9 Claims, 13 Drawing Sheets

DEFAULT STRB TIME: $STRB_{Def}$
MAXIMUM STRB TIME: $STRB_{Max}$
STRB TIME INCREASE RATE: $\Delta Y1$
STRB TIME DECREASE RATE: $\Delta Y3$ STROBE INCREASE PERIOD: T1
STROBE MAXIMUM PERIOD: T2
STROBE DECREASE PERIOD: T3
STROBE DEFAULT PERIOD: T4

...

| PHASE | STRB TIME |
|---|---|
| E1 | Y1 |
| E2 | Y2 |
| E3 | Y3 |
| E4 | Y4 |
| E5 | Y5 |
| E6 | Y6 |
| E7 | Y7 |
| E8 | Y8 |
| ... | |

FIG.14

| PHASE | DENSITY |
|---|---|
| E1 | C1 |
| E2 | C2 |
| E3 | C3 |
| E4 | C4 |
| E5 | C5 |
| E6 | C6 |
| E7 | C7 |
| E8 | C8 |
| ... | |

...

FIG.15

READING TIMING COUNT
READING TIME COUNT
DETECTED DENSITY/CORRECTION VALUE CONVERSION PARAMETERS

...

FIG.19A

| SECTION | DETECTION DATA (Pb) | DETECTION DATA (Pm) |
|---|---|---|
| 1 | 0.1 (V) | 0.5 (V) |
| 2 | 0.2 (V) | 1.1 (V) |
| 3 | 0.5 (V) | 3.0 (V) |
| 4 | 0.2 (V) | 1.1 (V) |
| 5 | 0.1 (V) | 0.5 (V) |

FIG.19B

| SECTION | IDEAL DATA RATIO (Bk) | IDEAL DATA RATIO (M) |
|---|---|---|
| 1 | 1.6 | 0.8 |
| 2 | 1.4 | 1.1 |
| 3 | 0.8 | 0.93 |
| 4 | 1.4 | 1.1 |
| 5 | 1.6 | 0.8 |

FIG.19C

| PHASE | STRB TIME (Bk) | STRB TIME (M) |
|---|---|---|
| 1 | 1.6 | 0.8 |
| 2 | 1.4 | 1.1 |
| 3 | 0.8 | 0.93 |
| 4 | 1.4 | 1.1 |
| 5 | 1.6 | 0.8 |

| SEC-TION | LIGHT EMISSION TIME (A) | LIGHT EMISSION TIME (B) | LIGHT EMISSION TIME (C) |
|---|---|---|---|
| 1 | 1.6 | 1.4 | 1.2 |
| 2 | 1.4 | 1.2 | 1.0 |
| ... | | | |

| SEC-TION | LIGHT EMISSION TIME (A') | LIGHT EMISSION TIME (B') | LIGHT EMISSION TIME (C') | LIGHT EMISSION TIME (D') |
|---|---|---|---|---|
| 1 | 1.7 | 1.5 | 1.3 | 1.1 |
| 2 | 1.5 | 1.3 | 1.1 | 0.9 |
| ... | | | | |

OPTICAL WRITING DEVICE, IMAGE FORMING APPARATUS, AND CORRECTION VALUE INFORMATION GENERATING METHOD

CROSS-REFERENCE TO RELATED APPLICATIONS

The present application claims priority to and incorporates by reference the entire contents of Japanese Patent Application No. 2011-107480 filed in Japan on May 12, 2011.

BACKGROUND OF THE INVENTION

1. Field of the Invention

The present invention relates to an optical writing device, an image forming apparatus, and a correction value information generating method.

2. Description of the Related Art

Recently, electronization of information has been encouraged, and image processing apparatuses such as printers or facsimiles used for outputting electronic information and scanners used for electronizing documents play essential roles accordingly. Such image processing apparatuses are often configured as multifunction peripherals (MFP) that can be used as a printer, a facsimile, a scanner, and a copying machine, by being provided with an image capturing function, an image forming function, and a communication function, for example.

Among such image processing apparatuses, electrophotographic image forming apparatuses are widely used as image forming apparatuses for outputting electronic documents. An electrophotographic image forming apparatus outputs an electronic document to a paper sheet by exposing the photosensitive element to form an electrostatic latent image, developing the electrostatic latent image into a toner image with a developer such as toner, and transferring the toner image onto the sheet.

In the electrophotographic image forming apparatus, available as optical writing devices used for exposing the photosensitive drum include a laser diode (LD) raster optical system and a light emitting diode (LED) writing system. A device of the LED writing system includes an LED array (LEDA) head.

The optical writing device of the LED writing system forms an electrostatic latent image by exposing the photosensitive drum with the LEDA as mentioned earlier. If the distance between the LEDA and the photosensitive drum changes, the spot diameter of the beams output from the LEDA and reaching the photosensitive drum also changes. As a result, an image density variation occurs.

For example, when the photosensitive drum is decentered or when the film thickness varies across the entire surface of the photosensitive drum, the distance between the photosensitive drum and the LEDA changes as the photosensitive drum is rotated. This results in a density variation along the subscanning direction in a formed image.

To address this issue, some technologies have been developed to keep the distance between the photosensitive drum and the light source constant (for example, see Japanese Patent Application Laid-open No. 2010-008913, Japanese Patent Application Laid-open No. 2006-187929, and Japanese Patent Application Laid-open No. H7-052447). Technologies for correcting a periodic variation caused by rotation of the photosensitive drum have been also developed (for example, see Japanese Patent Application Laid-open No. 2007-144731).

Using the technologies disclosed in Japanese Patent Application Laid-open No. 2010-008913, Japanese Patent Application Laid-open No. 2006-187929, and Japanese Patent Application Laid-open No. H7-52447 requires components for keeping the distance between the photosensitive drum and the light source constant. The arrangement of the components could be complex, resulting in an increase in apparatus and management costs and reduced productivity.

The technology disclosed in Japanese Patent Application Laid-open No. 2007-144731 can address an image quality variation caused by a relative speed variation of the surface of the photosensitive drum with respect to the light source because of a variation of the distance between the photosensitive drum and the light source.

Solely adjusting the light emission cycle of the light source, however, cannot address an image quality variation caused by a varying beam spot diameter or varying beam intensity because of a varying distance between the surface of the photosensitive drum and the light source.

In response to this issue, if the distance between the surface of the photosensitive drum and the light source is known across the entire circumferential surface of the photosensitive drum in the rotating direction, a correction can be made corresponding to the distance. The distance between the surface of the photosensitive drum and the light source, however, varies depending on how components are assembled within the apparatus. Apparatuses of the same model may have different distances, and such distances need to be obtained for individual apparatuses. Furthermore, the distance between the surface of the photosensitive drum and the light source could also change depending on how much the photosensitive drum are worn out, for example, by operations of the apparatus. Therefore, it is not realistic to manually obtain the distance between the surface of the photosensitive drum and the light source.

Therefore, there is a need for technique capable of obtaining a correction value for addressing a variation of the distance between a photosensitive drum and a light source with a simple structure.

SUMMARY OF THE INVENTION

It is an object of the present invention to at least partially solve the problems in the conventional technology.

According to an embodiment, there is provided an optical writing device that includes a light source; a first storage unit configured to sequentially store therein pieces of pixel information making up an image corresponding to main-scanning lines, respectively, the image being to be formed as an electrostatic latent image on a photosensitive element whose surface moves with respect to the light source by being rotated; a light emission control unit configured to cause the light source to emit light on the basis of each of the pieces of pixel information stored in the first storage unit; a rotational position recognizing unit configured to recognize a rotational position of the photosensitive element; a second storage unit configured to store therein correction value information in which the rotational position of the photosensitive element and information about correction to an amount of light emitted by the light source are associated with each other; a light amount control unit configured to control an amount of light emitted by the light source through the light emission control unit on the basis of the rotational position thus recognized, by referring to the correction value information; a reading signal acquiring unit configured to optically read an image that is formed by developing the electrostatic latent image and being conveyed to acquire a reading signal; and a correction value information generation control unit configured to generate the correction value information. The light emission control unit causes the light source to emit light on the basis of the rotational position thus recognized and pixel information making up a correction pattern to form an electrostatic latent image of the correction pattern on the photosensitive element, the correction pattern being formed across an entire circumference of the photosensitive element in a rotating direction and being used in generating the correction value information. The reading signal acquiring unit acquires reading signals resulting from reading the correction pattern that is formed by developing an electrostatic latent image of the correction pattern across the entire circumference of the photosensitive element in the rotating direction, generates, on the basis of the reading signals, density variation information in which a rotational position of the photosensitive element and a density of the correction pattern are associated with each other, and stores the density variation information in the second storage unit. The correction value information generation control unit generates information about correction to an amount of light emitted by the light source on the basis of the density of the correction pattern included in the density variation information thus generated to generate the correction value information and store the correction value information in the second storage unit.

According to another embodiment, there is provided an image forming apparatus that includes the optical writing device according to the above embodiment.

According to still another embodiment, there is provided a correction value information generating method that includes, on the basis of pixel information making up a correction pattern formed across an entire circumference of a photosensitive element in a rotating direction, forming an electrostatic latent image of the correction pattern on the photosensitive element by causing a light source to emit light on the basis of on a rotational position of the photosensitive element; acquiring reading signals resulting from reading the correction pattern that is formed by developing the electrostatic latent image of the correction pattern across the entire circumference of the photosensitive element in the rotating direction; generating, on the basis of the reading signals, density variation information in which a rotational position of the photosensitive element and a density of the correction pattern are associated with each other; generating information about correction to an amount of light emitted by the light source on the basis of the density of the correction pattern included in the generated density variation information; and generating correction value information in which the rotational position of the photosensitive element and the information about correction to an amount of light are associated with each other.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 14 is a schematic of an example of density variation information according to the embodiment;

FIG. 15 is a schematic of information maintained in an adjustment control unit according to the embodiment;

FIGS. 19A to 19C are schematics illustrating how the correction value information is generated according to the embodiment.

DETAILED DESCRIPTION OF THE PREFERRED EMBODIMENTS

An embodiment of the present invention will now be explained in detail with reference to some drawings. In the embodiment, as an image forming apparatus, an example of a multifunctional peripheral (MFP) is explained. However, the image forming apparatus does not need to be an MFP, and may be a copying machine, a printer, a facsimile, and the like.

Figure 1:
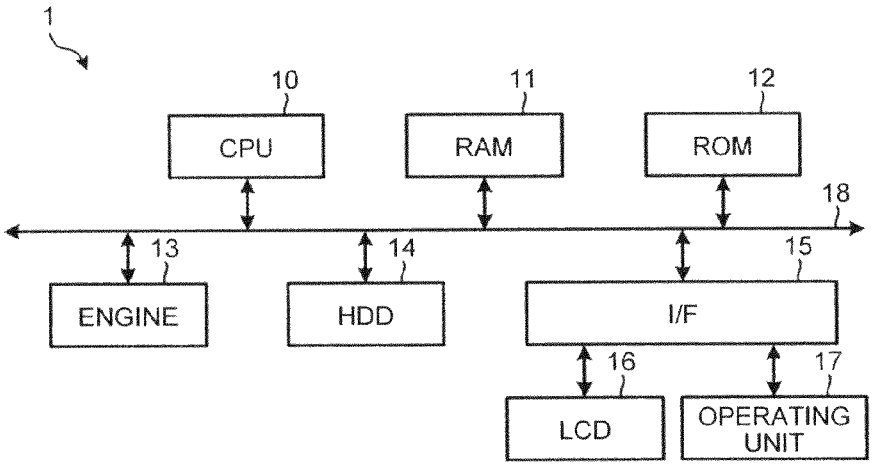
FIG. 1 is a block diagram illustrating a hardware configuration of an image forming apparatus according to an embodiment of the present invention.

FIG. 1 is a block diagram illustrating a hardware configuration of an image forming apparatus 1 according to the embodiment. As illustrated in FIG. 1, the image forming apparatus 1 according to the embodiment has an engine for executing image formation, in addition to structures of a general information processing terminal such as a server or a personal computer (PC). In other words, in the image forming apparatus 1 according to the embodiment, a central processing unit (CPU) 10, a random access memory (RAM) 11, a read-only memory (ROM) 12, an engine 13, a hard disk drive (HDD) 14, and an interface (I/F) 15 are connected to each other via a bus 18. A liquid crystal display (LCD) 16 and an operating section 17 are connected to the I/F 15.

The CPU 10 is a computing unit, and controls operations of the entire image forming apparatus 1. The RAM 11 is a volatile storage unit from or to which information can be read or written at a high speed, and is used as a working area when the CPU 10 processes information. The ROM 12 is a read-only nonvolatile storage unit, and stores therein computer programs such as firmware. The engine 13 is a mechanism that actually performs image formation in the image forming apparatus 1.

The HDD 14 is a nonvolatile storage unit from or to which information can be read or written, and stores therein an operating system (OS), various control programs, application programs, and the like. The I/F 15 connects and controls the bus 18 and various hardware, a network, and the like. The LCD 16 is a visual user interface for allowing a user to check the status of the image forming apparatus 1. The operating section 17 is a user interface, such as a keyboard and a mouse, for allowing a user to input information to the image forming apparatus 1.

In such a hardware configuration, the computer programs stored in a storage unit such as the ROM 12, the HDD 14, and an optical disk not illustrated are read onto the RAM 11, and the CPU 10 performs operations following the computer programs, to realize a software controller. A combination of the software controller thus realized and the hardware realizes functional blocks for enabling functions of the image forming apparatus 1 according to the embodiment.

Figure 2:
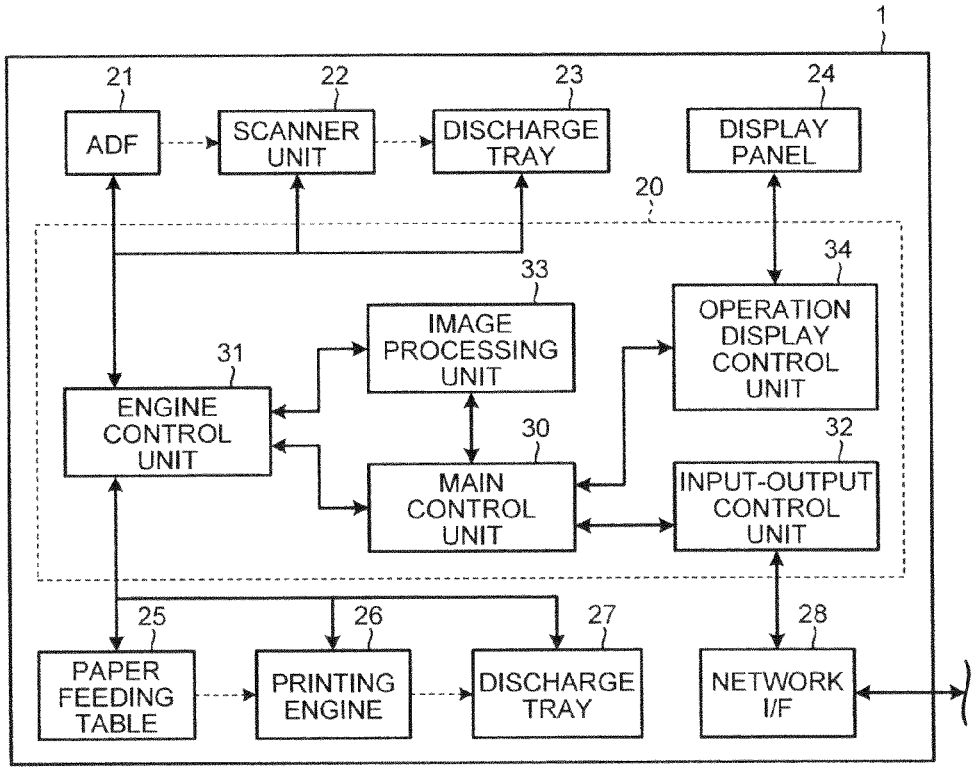
FIG. 2 is a block diagram illustrating a functional configuration of the image forming apparatus according to the embodiment.

A functional configuration of the image forming apparatus 1 according to the embodiment will now be explained with reference to FIG. 2. FIG. 2 is a block diagram illustrating a functional configuration of the image forming apparatus 1 according to the embodiment. As illustrated in FIG. 2, the image forming apparatus 1 according to the embodiment includes a controller 20, an automatic document feeder (ADF) 21, a scanner unit 22, a discharge tray 23, a display panel 24, a paper feeding table 25, a printing engine 26, a discharge tray 27, and a network I/F 28.

The controller 20 includes a main control unit 30, an engine control unit 31, an input-output control unit 32, an image processing unit 33, and an operation display control unit 34. As illustrated in FIG. 2, the image forming apparatus 1 according to the embodiment is configured as an MFP having the scanner unit 22 and the printing engine 26. In FIG. 2, electrical connections are indicated by arrows in a solid line, and movement of a paper sheet is indicated by arrows in a dotted line.

The display panel 24 functions as an output interface that visually displays the status of the image forming apparatus 1, and also as an input interface (operating unit) that is a touch panel for allowing a user to operate the image forming apparatus 1 directly or to input information to the image forming apparatus 1. The network I/F 28 is an interface for allowing the image forming apparatus 1 to communicate with other apparatuses over a network, and an Ethernet (registered trademark) interface or an universal serial bus (USB) interface is used.

The controller 20 is realized by a combination of software and hardware. Specifically, the controller 20 includes a software controller realized by loading control programs such as firmware stored in the ROM 12, a nonvolatile memory, a nonvolatile recording medium, e.g., the HDD 14, and the optical disk, onto a volatile memory (hereinafter, referred to as a memory) such as the RAM 11 under the control of the CPU 10, and hardware such as an integrated circuit. The controller 20 functions as a control unit that controls the entire image forming apparatus 1.

The main control unit 30 plays a role of controlling each of the units included in the controller 20, and gives instructions to each of the units included in the controller 20. The engine control unit 31 plays a role as a driving unit that controls or drives the printing engine 26, the scanner unit 22, and the like. The input-output control unit 32 inputs signals and instructions received via the network I/F 28 to the main control unit 30. The main control unit 30 controls the input-output control unit 32, and accesses other apparatuses via the network I/F 28.

The image processing unit 33 generates drawing information based on print information included in a received print job, under the control of the main control unit 30. The drawing information is information for allowing the printing engine 26 that is an image forming unit to draw an image through an image forming operation, and is pixel information being information of pixels making up the image to be output. The print information included in a print job is image information converted by a printer driver installed in an information processing apparatus such as a PC into a format that can be recognized by the image forming apparatus 1. The operation display control unit 34 displays information onto the display panel 24, or notifies information input via the display panel 24 to the main control unit 30.

When the image forming apparatus 1 operates as a printer, the input-output control unit 32 receives a print job via the network I/F 28 to begin with. The input-output control unit 32 forwards the print job thus received to the main control unit 30. Upon receiving the print job, the main control unit 30 controls the image processing unit 33 to generate drawing information based on the print information included in the print job.

Once the drawing information is generated by the image processing unit 33, the engine control unit 31 performs image formation onto a paper sheet conveyed from the paper feeding table 25, based on the drawing information generated. In other words, the printing engine 26 functions as an image forming unit. The paper sheet on which an image is formed by the printing engine 26 is discharged onto the discharge tray 27.

When the image forming apparatus 1 operates as a scanner, in response to a user operation made on the display panel 24 or a reading execution instruction received from an external PC and the like via the network I/F 28, the operation display control unit 34 or the input-output control unit 32 forwards the reading execution signal to the main control unit 30. The main control unit 30 controls the engine control unit 31 based on the reading execution signal thus received.

The engine control unit 31 drives the ADF 21 to convey a document having an image to be captured and placed on the ADF 21 to the scanner unit 22. The engine control unit 31 also drives the scanner unit 22 to capture the image of the document conveyed by the ADF 21. When the document is not set on the ADF 21 but is directly placed on the scanner unit 22, the scanner unit 22 captures the image of the document thus placed, under the control of the engine control unit 31. In other words, the scanner unit 22 operates as an image capturing unit.

In an image capturing operation, an image capturing element, such as a charge coupled device (CCD) included in the scanner unit 22 optically scans the document, and information of the captured image is generated based on the optical information. The engine control unit 31 forwards the captured image information generated by the scanner unit 22 to the image processing unit 33. The image processing unit 33 generates image information based on the captured image information received from the engine control unit 31, under the control of the main control unit 30. The image information generated by the image processing unit 33 is stored in a storage unit such as the HDD 14 mounted on the image forming apparatus 1. In other words, the scanner unit 22, the engine control unit 31, and the image processing unit 33 function as a document reading unit by cooperating with each other.

The image information generated by the image processing unit 33 is stored in the HDD 14 and the like as it is, or transmitted to an external apparatus via the input-output control unit 32 and the network I/F 28 based on a user instruction. In other words, each of the ADF 21 and the engine control unit 31 functions as an image input unit.

When the image forming apparatus 1 operates as a copying machine, the image processing unit 33 generates drawing information based on the captured image information received by the engine control unit 31 from the scanner unit 22 or the image information generated by the image processing unit 33. Based on the drawing information, the engine control unit 31 drives the printing engine 26 in the same manner as in a printer operation.

Figure 3:
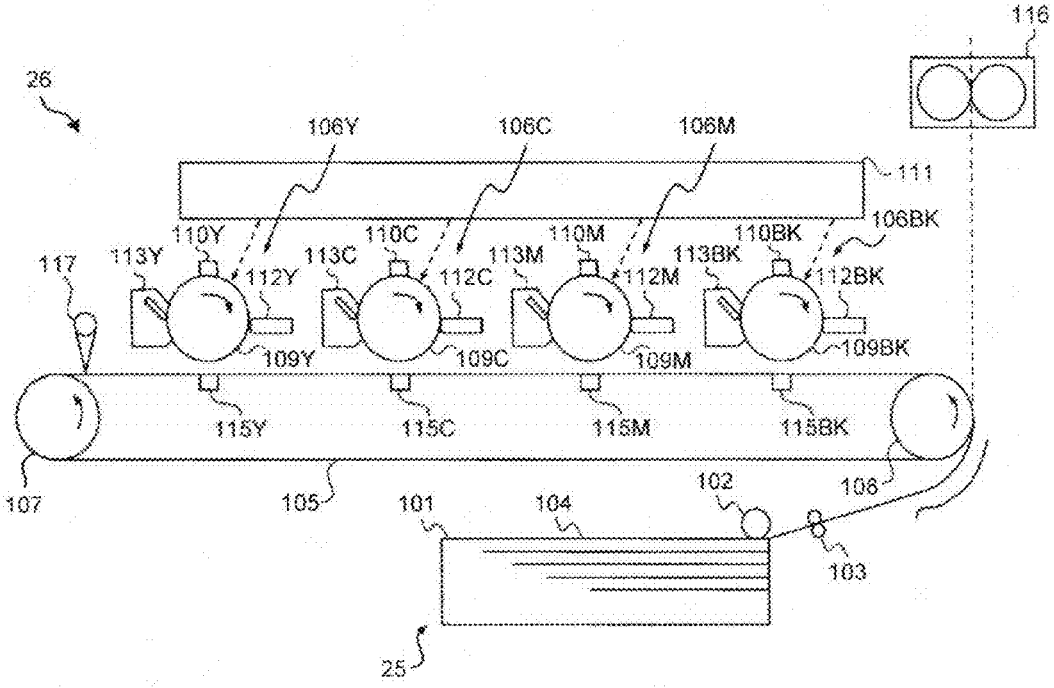
FIG. 3 is a schematic of a structure of a printing engine according to the embodiment.

A structure of the printing engine 26 according to the embodiment will now be explained with reference to FIG. 3. As illustrated in FIG. 3, the printing engine 26 according to the embodiment has a so-called tandem structure including image forming units (electrophotographic processing units) 106BK, 106M, 106C, and 106Y in respective colors arranged along a carriage belt 105 that is a moving unit. Specifically, the plurality of image forming units 106BK, 106M, 106C, 106Y are arranged along the carriage belt 105 sequentially from the upstream side in the conveying direction of the carriage belt 105 that is an intermediate transfer belt where an intermediate transfer image is transferred onto a paper sheet (an example of a recording medium) 104 that is fed by a paper feeding roller 102 from a paper feed tray 101 and separated by separating rollers 103.

The internal structures of the image forming units 106BK, 106M, 106C, 106Y are the same, except that the color of the toner image formed by each of image forming units 106BK, 106M, 106C, 106Y is different. The image forming unit 106BK forms a black image, the image forming unit 106M forms a magenta image, the image forming unit 106C forms a cyan image, and the image forming unit 106Y forms a yellow image. In the explanation below, the image forming unit 106BK will be explained specifically, and, because the other image forming units 106M, 106C, 106Y are the same as the image forming unit 106BK, elements included in the respective image forming units 106M, 106C, 106Y are assigned with discriminating signs M, C, Y, instead of BK appended to the image forming unit 106BK, and are illustrated in drawings only, and explanations thereof are omitted hereunder.

The carriage belt 105 is an endless belt stretched across a driving roller 107 that is driven in rotation, and a driven roller 108. The driving roller 107 is driven in rotation by a driving motor not illustrated. The driving motor, the driving roller 107, and the driven roller 108 function as a driving unit for moving the carriage belt 105 that is the moving unit.

When an image is to be formed, the first image forming unit 106BK transfers a black toner image onto the carriage belt 105 that is driven in rotation. The image forming unit 106BK includes a photosensitive drum 109BK as a photosensitive drum, and a charging device 110BK, an optical writing device 111, a developing device 112BK, a photosensitive drum cleaning device (not illustrated), and a neutralization device 113BK each of which are arranged around the photosensitive drum 109BK. The optical writing device 111 is configured to irradiate each of the photosensitive drums 109BK, 109M, 109C, 109Y (hereinafter, any one of the photosensitive drums is referred to as a "photosensitive drum 109") with light.

When an image is to be formed, after the outer circumferential surface of the photosensitive drum 109BK is uniformly charged by the charging device 110BK in the darkness, writing is performed to the outer circumferential surface by light output from a light source and included in the optical writing device 111, and an electrostatic latent image corresponding to a black image is thus formed. The developing device 112BK visualizes the electrostatic latent image with black toner. In this manner, a black toner image is formed on the photosensitive drum 109BK.

The toner image is transferred onto the carriage belt 105 by an operation of a transfer unit 115BK at a position (transfer position) where the photosensitive drum 109BK and the carriage belt 105 abut against each other or are nearest each other. By this transfer, a black toner image is formed on the carriage belt 105. On the photosensitive drum 109BK from which the toner image is transferred, the waste toner remaining on the outer circumferential surface is wiped by the photosensitive element cleaning device, and neutralized by the neutralization device 113BK, and kept stand by for the next image formation.

By driving rollers of the carriage belt 105, the black toner image transferred onto the carriage belt 105 in the image forming unit 106BK in the manner described above is conveyed to the next image forming unit 106M. In the image forming unit 106M, a magenta toner image is formed on the photosensitive drum 109M through the same image forming process as that performed in the image forming unit 106BK, and the toner image is transferred over the black image that is already formed, in a manner superimposed over the black image.

The black and the magenta toner images transferred onto the carriage belt 105 are further conveyed into the next image forming units 106C, 106Y, and a cyan toner image formed on the photosensitive drum 109C and a yellow toner image formed on the photosensitive drum 109Y are transferred onto the images that are already transferred in a superimposed manner through the same operations. In this manner, a full-color intermediate transfer image is formed on the carriage belt 105.

The paper sheet 104 stored in the paper feed tray 101 is sequentially fed from the sheet at the top, and the intermediate transfer image formed on the carriage belt 105 is transferred onto the surface of the paper sheet at a position where the conveying channel comes into contact with or nearest to the carriage belt 105. In this manner, an image is formed on the surface of the paper sheet 104. The paper sheet 104 having the image thus formed on the surface is further conveyed. After the image is fixed in a fixing unit 116, the paper sheet 104 is discharged from the image forming apparatus 1.

In the image forming apparatus 1, due to an error in the distance between axes of the photosensitive drums 109BK, 109M, 109C, 109Y, an error in parallelism between the photosensitive drums 109BK, 109M, 109C, 109Y, an installation error of the light sources in the optical writing device 111, and an operational timing error at which electrostatic latent images are written to the photosensitive drums 109BK, 109M, 109C, 109Y, there are cases where the toner images in the respective colors are not superimposed over one another at positions where such toner images should be superimposed over one another, and a positional deviation between the colors might occur.

In addition, due to the same causes, in a paper sheet on which the image is transferred, the image could be transferred onto an area outside of an area where the image should be transferred. Known as main components of such a positional deviation are a skew, a registration error in the sub-scanning direction, a scaling factor error in the main-scanning direction, and a registration error in the main-scanning direction. An error in the conveyed distance, for example, caused by a rotation speed error of the conveying roller that conveys the paper sheet or by a worn conveying roller is also known.

To correct such a positional deviation, pattern detection sensors 117 are provided. Each of the pattern detection sensors 117 is a photosensor that scans positional deviation correction patterns transferred onto the carriage belt 105 by the photosensitive drums 109BK, 109M, 109C, 109Y, and includes a light emitting element for irradiating the correction patterns drawn on the surface of the carriage belt 105 with light, and a light receiving element for receiving light reflected on the correction patterns. As illustrated in FIG. 3, the pattern detection sensors 117 are arranged on the same board in a direction perpendicular to the conveying direction of the carriage belt 105, at a position downstream of the photosensitive drums 109BK, 109M, 109C, 109Y.

The pattern detection sensors 117 according to the embodiment are also used as sensors for measuring a density variation corresponding to a variation in the distance between each of the photosensitive drums 109 in each of the colors and the light source for exposing each of the photosensitive drums. Measuring the density variation corresponding to the distance variation between each of the photosensitive drums and the light source exposing each of the photosensitive drums using the pattern detection sensors 117 is an essential feature of the embodiment. Such a measurement will be described later in detail.

Figure 4:
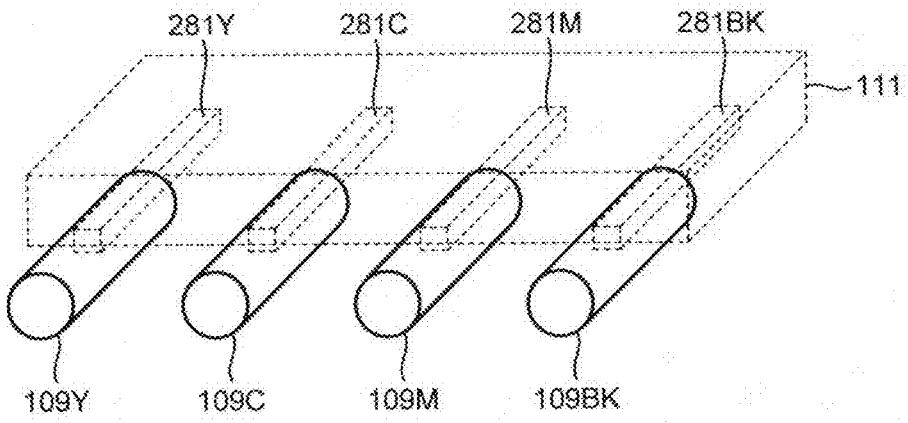
FIG. 4 is a schematic illustrating a general structure of the optical writing device according to the embodiment.

The optical writing device 111 according to the embodiment will now be explained. FIG. 4 is a schematic illustrating a positional relationship between the optical writing device 111 according to the embodiment and the photosensitive drums 109. As illustrated in FIG. 4, the light with which the photosensitive drums 109BK, 109M, 109C, 109Y in the respective colors are irradiated is output from respective LED arrays (LEDAs) 281BK, 281M, 281C, 281Y (hereinafter, any one of the LEDAS is referred to as an LEDA 281) that are the light sources.

Each of the LEDAs 281 includes LEDs that are light emitting elements arranged along the main-scanning direction of the photosensitive drum 109. A controller in the optical writing device 111 controls on/off status of each of the LEDs arranged in each main-scanning line in the main-scanning direction, based on image data that is to be output, so that the surface of the photosensitive drum 109 is selectively exposed and an electrostatic latent image is formed on the photosensitive drum 109.

Figure 5:
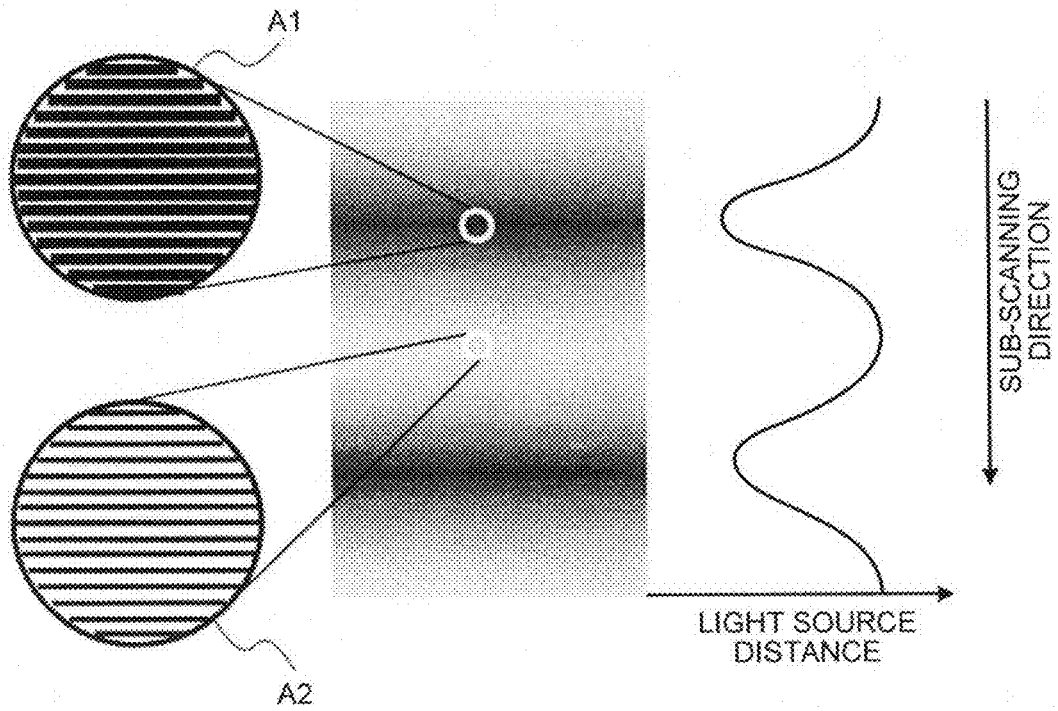
FIG. 5 is a conceptual schematic illustrating a problem to be solved by the optical writing device according to the embodiment.

A problem caused by a variation in the distance between the photosensitive drum and the light source will now be explained with reference to FIG. 5. FIG. 5 is a schematic of an example of an image that is actually output when an image forming output is performed based on image data representing a band-shaped image having uniform density, and the distance between the light source and the photosensitive drum in the sub-scanning direction of the image (hereinafter, referred to as a light source distance). As illustrated in FIG. 5, it can be seen that dark-colored parts and light-colored parts are present along the sub-scanning direction.

Generally, each beam output from the LEDA 281 has a focal point on the surface of the photosensitive drum 109, and is adjusted so that the spot diameter of each of the beams is constant on the surface of the photosensitive drum 109. However, because the distance between the photosensitive drum 109 and the LEDA 281 varies while the photosensitive drum 109 is rotated, due to a variation in the film thickness of the photosensitive drum 109 or decentering of the photosensitive drum 109, the spot diameter of the beams reaching the surface of the photosensitive drum 109 also varies, and, as a result, an image density variation occurs in the sub-scanning direction.

In the example illustrated in FIG. 5, when the light source distance is reduced, the density is increased. In other words, a dark-colored portion corresponds to a part where the light source distance is short. When the light source distance is short, the spot diameter of the beam output from the LEDA becomes large, and the width of the image formed by each main-scanning line in the sub-scanning direction is increased, as illustrated in A1 in FIG. 5. As a result, the color becomes darker. A light-colored portion corresponds to a part where the light source distance is long. When the light source distance is long, the spot diameter of the beam output from the LEDA becomes smaller, and, the width of the image formed by each of the main-scanning lines in the sub-scanning direction is reduced, as illustrated in A2 in FIG. 5. As a result, the color becomes lighter.

Because, when the light source distance becomes longer, the intensity of the beam on the surface of the photosensitive drum 109 is reduced by that amount, the exposing intensity on the photosensitive drum 109 is also reduced, and the density might be reduced. In either case, it is for sure that the light source distance varies as the photosensitive drum 109 is rotated, and such a variation results in an image density variation in the sub-scanning direction. Being a solution to such a problem is an essence of the embodiment.

Figure 6A:
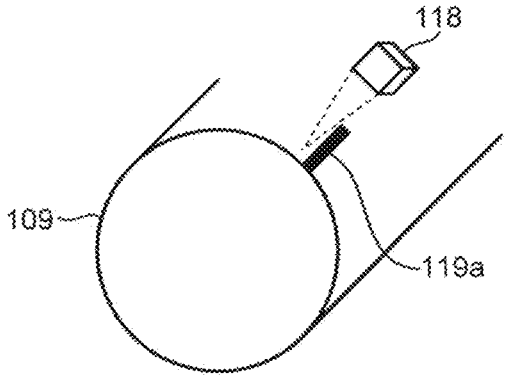
FIGS. 6A and 6B are general schematics of photosensitive drums according to the embodiment.

As a workaround to this problem, in the optical writing device 111 according to the embodiment, a photosensitive element cycle detection marker 119*a* is arranged on the edge of the photosensitive drum 109 in the main-scanning direction, as illustrated in FIG. 6A, and a phase detection sensor 118 is provided to detect the photosensitive element cycle detection marker 119*a*. The phase of the rotation of the photosensitive drum 109 is detected by the phase detection sensor 118, and the light output from the LEDA 281 is controlled based on the detection result. In this manner, the density variation corresponding to the variation in the distance between the photosensitive drum and the light source is corrected. The phase detection sensor 118 is arranged so as to detect the same position exposed by the LEDA 281 in the sub-scanning direction.

Figures 7, 8:
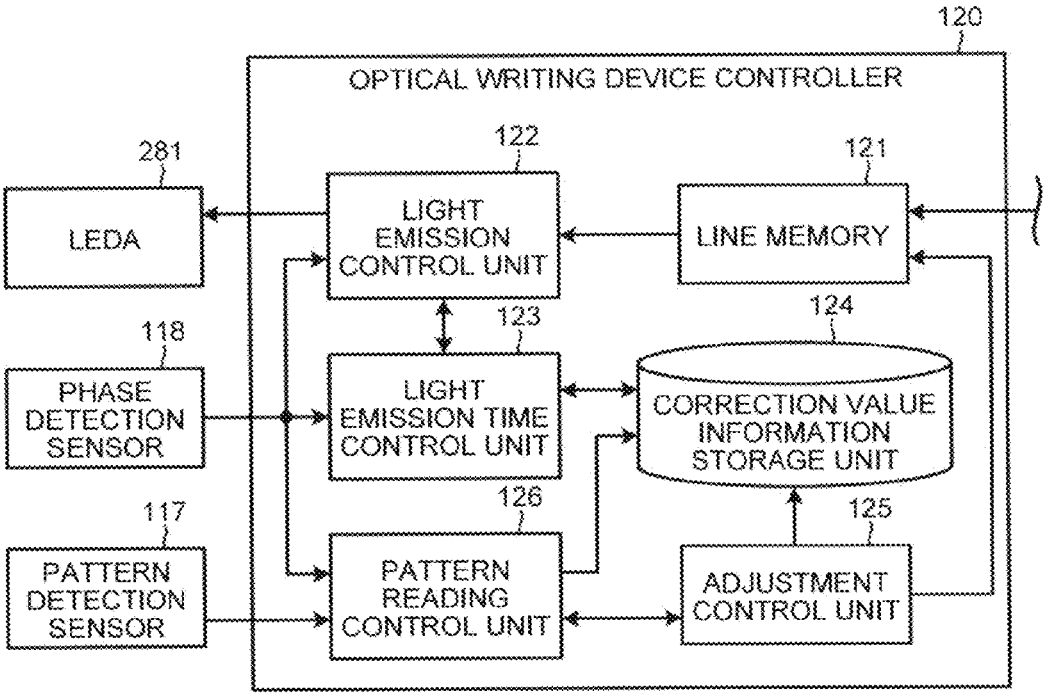
FIG. 7 is a block diagram illustrating an optical writing device controller according to the embodiment.
FIG. 8 is a schematic of an example of the correction value information according to the embodiment.

Controlling blocks of the optical writing device 111 according to the embodiment will now be explained with reference to FIG. 7. FIG. 7 is a schematic illustrating a functional configuration of an optical writing device controller 120 for controlling the optical writing device 111 according to the embodiment, and connections between the LEDA 281, the pattern detection sensors 117, and the phase detection sensor 118. As illustrated in FIG. 7, the optical writing device controller 120 according to the embodiment includes a line memory 121, a light emission control unit 122, a light emission time control unit 123, a correction value information storage unit 124, an adjustment control unit 125, and a pattern reading control unit 126.

The optical writing device 111 according to the embodiment also includes an information processing mechanism such as the CPU 10 and storage units, e.g., the RAM 11 and the ROM 12, such as those explained with reference to FIG. 1. The optical writing device controller 120 as illustrated in FIG. 7 is also realized as a combination of hardware and a software controller that is realized by loading the control programs stored in a storage units such as the ROM 12 onto the RAM 11, and causing the CPU 10 to execute operations following the computer program, in the same manner as in the controller 20 in the image forming apparatus 1.

In the explanation below, a configuration of the optical writing device controller 120 and functions of the optical writing device controller 120 performed for the LEDA 281 and the phase detection sensor 118 will be explained. As explained earlier with reference to FIGS. 3 and 4, the LEDAs 281 are arranged for the respective photosensitive drums 109BK, 109M, 109C, 109Y, and the phase detection sensors 118 are also arranged for the respective photosensitive drums 109BK, 109M, 109C, 109Y. Therefore, the optical writing device controller 120 has functions for performing control corresponding to each of the phase detection sensors 118 arranged for the respective LEDAs 281 and each of the photosensitive drums 109 for the respective colors.

The line memory 121 receives the image information (the drawing information mentioned above) from the controller 20, and stores information of pixels making up the image in a storage area provided for each of the main-scanning lines. In other words, the line memory 121 functions as a pixel information acquiring unit and a line pixel information storage unit.

The light emission control unit 122 is a light source controller that controls the light output from the LEDA 281 based on the pixel information stored in the line memory 121. The light emission control unit 122 reads the pixel information stored in the line memory 121 in units of the main-scanning line with reference to a sub-scanning direction clock, and controls on/off of the LEDA 281.

As mentioned earlier, the light emission time control unit 123 adjusts the amount of the light output from the LEDA 281 by controlling strobe time that is an output time for which the light emission control unit 122 causes the LEDA 281 to emit light (hereinafter, referred to as STRB time). The light emission time control unit 123 adjusts the light amount based on a periodic signal received from the phase detection sensor 118, with reference to correction value information stored in the correction value information storage unit 124. In other words, the light emission time control unit 123 functions as a rotational position recognizing unit that recognizes the phase, that is, a rotational position of the photosensitive drum 109, and as a light amount control unit.

The adjustment control unit 125 controls various adjusting operations performed in the optical writing device controller 120. For example, the adjustment control unit 125 generates positional deviation correction patterns for correcting a positional deviation, and generates a value for adjusting the operational timing at which images are formed based on a result of reading the positional deviation correction patterns.

Furthermore, as an essential function according to the embodiment, the adjustment control unit 125 generates patterns used for measuring a density variation corresponding to the variation in the distance between each of the photosensitive drums and the light source exposing each of the photosensitive drums, controls the operational timing at which the patterns are read, and generates a correction value based on a result of reading the patterns.

The pattern reading control unit 126 acquires a pattern reading signal from the pattern detection sensors 117, stores the pattern reading signal in the correction value information storage unit 124, and inputs the pattern reading signal to the adjustment control unit 125.

FIG. 8 is a schematic of an example of correction value information for correcting the density variation corresponding to the variation in the distance between the light source exposing each of the photosensitive drums and each of the photosensitive drums (hereinafter, referred to as density variation correction value information), among the correction value information stored in the correction value information storage unit 124. As illustrated in FIG. 8, the density variation correction value information according to the embodiment includes information of "$STRB_{Def}$" indicating default STRB time during which light is output from each line of the LEDA 281, "$STRB_{Max}$" indicating the maximum STRB time used in adjusting the STRB time, "ΔY1" indicating a rate at which the STRB time is increased, represented as an increase per unit time, while the STRB time is adjusted, "ΔY3" indicating a rate at which the STRB time is decreased, represented as a decrease per unit time, while the STRB time is reduced in a similar manner, "T1" indicating a period during which the STRB time is increased, "T2" indicating a period during which the strobe time is kept at the maximum value, "T3" indicating a period during which the strobe time is reduced, and "T4" indicating a period during which the strobe time is maintained to the default value.

Figures 9, 10:
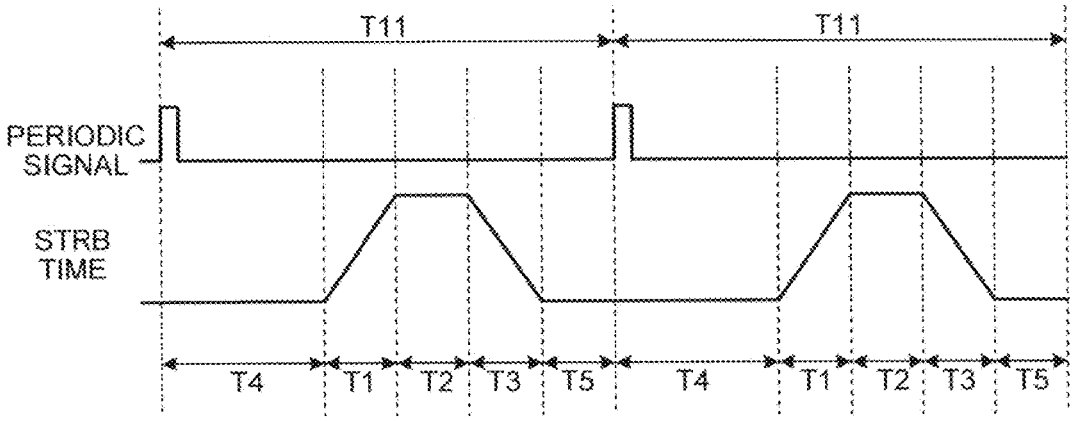
FIG. 9 is timing chart illustrating how the light amount is adjusted according to the embodiment.
FIG. 10 is a schematic of an example of the correction value information according to the embodiment.

Each piece of information illustrated in FIG. 8 is set and stored so as to adjust the amount of light output from the LEDA 281 so that deterioration of the image quality caused by the variation of the light source distance is prevented, based on the variation of the light source distance corresponding to the rotation of the photosensitive drum 109. A time sequence in which the light emission time control unit 123 adjusts the STRB time with reference to the correction value information will now be explained with reference to FIG. 9. FIG. 9 is a timing chart illustrating a periodic signal output when the phase detection sensor 118 detects the photosensitive element periodic detection marker 119*a* while the photosensitive drum 109 is rotated, and control of the STRB time performed by the light emission time control unit 123.

As illustrated in FIG. 9, when the periodic signal output from the phase detection sensor 118 rises, the light emission time control unit 123 outputs a control signal to the light emission control unit 122 to set the STRB time to $STRB_{Def}$ that is a default value. The light emission control unit 122 then uses $STRB_{Def}$ as the STRB time for causing the LEDA 281 to emit light during the strobe default time T4.

When the periodic signal of the phase detection sensor 118 is detected, the light emission time control unit 123 starts counting. When the count reaches a value corresponding to T4, the light emission time control unit 123 resets the counter, and outputs a control signal to the light emission control unit 122, to increase the STRB time at the increase ratio ΔY1 with reference to the counter. In this manner, as illustrated in FIG. 9, the STRB time is increased as time elapses.

As an example of the number counted by the light emission time control unit 123, the actual time, the number of pulses of the motor that rotates the photosensitive drum 109, the number of a rotation detection signal that is output with reference to a rotation of the photosensitive drum 109, or the internal clock of the optical writing device controller 120 may be used, for example. T1 to T4 illustrated in FIG. 8 are stored in the correction value information storage unit 124 as information corresponding to the number thus counted.

As described above, the light emission control unit 122 adjusts the STRB time used for causing the LEDA 281 to emit light based on the control signal received from the light emission time control unit 123. Therefore, during the strobe increase period T1, the STRB time used by the light emission control unit 122 in causing the LEDA 281 to emit light is increased by the increase ratio of ΔY1 as the time elapses.

When the count of the counter reset at the beginning of the strobe increase period T1 reaches a value corresponding to T1, the light emission time control unit 123 resets the counter, and outputs a control signal to the light emission control unit 122 to increase the STRB time to the maximum value $STRB_{max}$. In this manner, for the time period of the strobe maximum time T2, the light emission control unit 122 uses $STRB_{Max}$ as the STRB time for causing the LEDA 281 to emit light.

In the example illustrated in FIG. 9, ΔY1 is set so that the STRB time reaches $STRB_{Max}$ just when the strobe increase period T1 elapses. However, ΔY1 is not limited thereto, and ΔY1 may also be set so that the STRB time reaches $STRB_{Max}$ before T1 elapses. In such a case, the light emission time control unit 123 outputs a control signal so that the STRB time is not increased more than $STRB_{Max}$ in the time T1.

When the count of the counter reset at the beginning of the strobe increase period T2 reaches a value corresponding to T2, the light emission time control unit 123 resets the counter, and outputs a control signal to the light emission control unit 122 to reduce the STRB time by the reduction ratio of ΔY3 with reference to the counter. In this manner, during the strobe decrease period T3, the light emission control unit 122 reduces the STRB time for causing the LEDA 281 to emit light at the reduction ratio of ΔY3 as the time elapses, as illustrated in FIG. 9.

When the count of the counter reset at the beginning of the strobe decrease period T3 reaches a value corresponding to T3, the light emission time control unit 123 outputs a control signal to the light emission control unit 122 to set the STRB time to $STRB_{Def}$ that is the default value. In this manner, during the time T5 that is from when T3 has elapsed to when the next periodic signal is detected, the light emission control unit 122 uses $STRB_{Def}$ as the STRB time for causing the LEDA 281 to emit light.

With the cycle of T4, T1, T2, T3, and T5, as illustrated as time T11 in FIG. 9, the STRB time adjustment corresponding to a single rotation of the photosensitive drum 109 is completed. To explain more about the time T11, during the time T4 and the time T5, the STRB time is set to the default value. In other words, these are time periods during which the minimum STRB time is used. These are time periods corresponding to darker parts of the image, as illustrated as A1 in FIG. 5, because of the short light source distance.

By contrast, the time periods T1 to T3 in FIG. 9 are time periods during which the STRB time is increased to the maximum value, and is then reduced to the default STRB time. These time periods are time periods corresponding to lighter parts of the image, as illustrated as A2 in FIG. 5, because of the longer light source distance. In other words, in the embodiment, when the image density variation occurs in an image, as illustrated in FIG. 5, the STRB time is increased for an area where the color of the image is light so that the light amount is increased and the image density is prevented from being reduced. As an approach for increasing or decreasing the STRB time, the STRB time may be increased by ΔY1 or decreased by ΔY3 for each line of the light emission control.

FIG. 10 is a schematic of another example of the density variation correction value information. As the density variation correction value information illustrated in FIG. 10, the "phase" of the photosensitive drum 109 that is determined based on a detection of the photosensitive element cycle detection marker 119*a* and the "STRB time" used for each of the phases are stored in an associated manner.

Figure 6B:
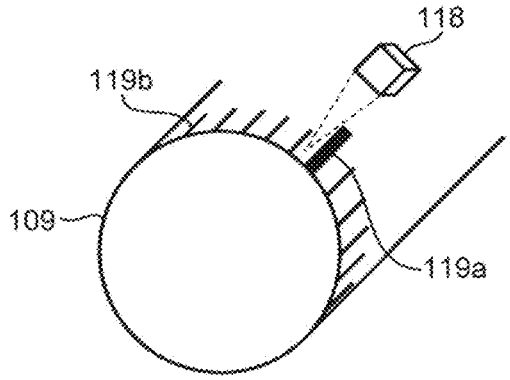

In other words, the light emission time control unit 123 using the density variation correction value information illustrated in FIG. 10 acquires the information as illustrated in FIG. 10 from the correction value information storage unit 124, and sends a control signal for controlling the STRB time during which the LEDA 281 is caused to emit light to the light emission control unit 122 with reference to the periodic signal received from the phase detection sensor 118. In the example illustrated in FIG. 10, the phase "E1" is the phase corresponding to the timing at which the photosensitive element cycle detection marker 119*a* illustrated in FIGS. 6A and 6B is detected.

Figure 11:
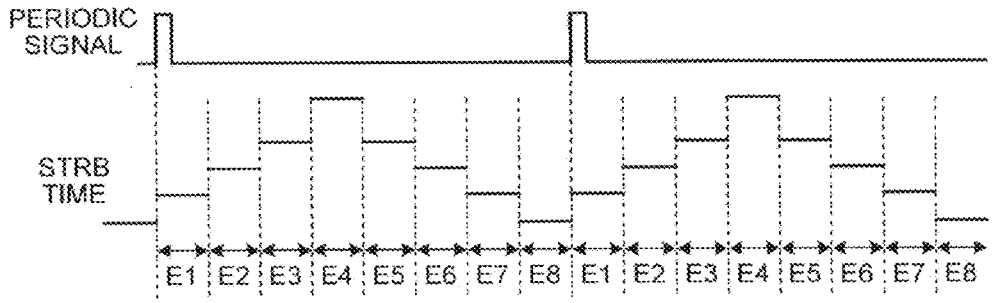
FIG. 11 is a timing chart illustrating a method for adjusting the light amount according to the embodiment.

FIG. 11 is a schematic of a time sequence of an adjustment of the STRB time when the exemplary density variation correction value information illustrated in FIG. 10 is used. FIG. 10 illustrates a timing chart indicating the periodic signal output from the phase detection sensor 118 when the photosensitive element cycle detection marker 119*a* is detected as the photosensitive drum 109 is rotated, and the STRB time controlled by the light emission time control unit 123, in the same manner as in FIG. 9.

As illustrated in FIG. 11, the light emission time control unit 123 outputs a control signal specifying the STRB time "Y1", which corresponds to the phase "E1" illustrated in FIG. 10, to the light emission control unit 122 at the timing of a rise of the periodic signal output from the phase detection sensor 118. In this manner, for a time period corresponding to the phase "E1", the light emission control unit 122 uses "Y1" as the STRB time during which the LEDA 281 is caused to emit light.

Upon detecting the periodic signal output from the phase detection sensor 118, the light emission time control unit 123 initiates the counter. When the count reaches a value corresponding to respective time periods "E1", "E2", "E3" . . . illustrated in FIG. 10, the light emission time control unit 123 resets the counter, acquires the STRB time associated with the upcoming phase from the density variation correction value information illustrated in FIG. 10, and inputs the STRB time to the light emission control unit 122 as a control signal.

By repeating these operations, the light emission control unit 122 controls the STRB time for which the LEDA 281 is caused to emit light based on "STRB time" specified in correction value information illustrated in FIG. 10, across the entire circumference of the photosensitive drum 109 corresponding to a single rotation. According to the method illustrated in FIG. 11, more precise control of the STRB time can be realized, compared with the method explained with reference to FIGS. 8 and 9.

Instead of determining each of the phases based on a count, the phase may also be determined by detecting the actual phase of the photosensitive drum 109 once the periodic signal is detected as indicated in FIG. 11. Such an example will now be explained. FIG. 6B is a schematic of the photosensitive drum 109 used for detecting the phase of the photosensitive drum 109. On the exemplary photosensitive drum 109 illustrated in FIG. 6B, photosensitive element phase detection markers 119*b* are arranged at a given interval, in addition to the photosensitive element cycle detection marker 119*a*.

Because the photosensitive element cycle detection marker 119*a* and the photosensitive element phase detection marker 119*b* have different widths in the sub-scanning direction, time period during which the detection signal of the phase detection sensor 118 is set to a detection state differs when the photosensitive element cycle detection marker 119*a* is detected and when the photosensitive element phase detection markers 119*b* is detected. The light emission time control unit 123 distinguishes the photosensitive element cycle detection marker 119*a* and the photosensitive element phase detection markers 119*b* using this difference in the detection signal output from the phase detection sensor 118.

Figure 12:
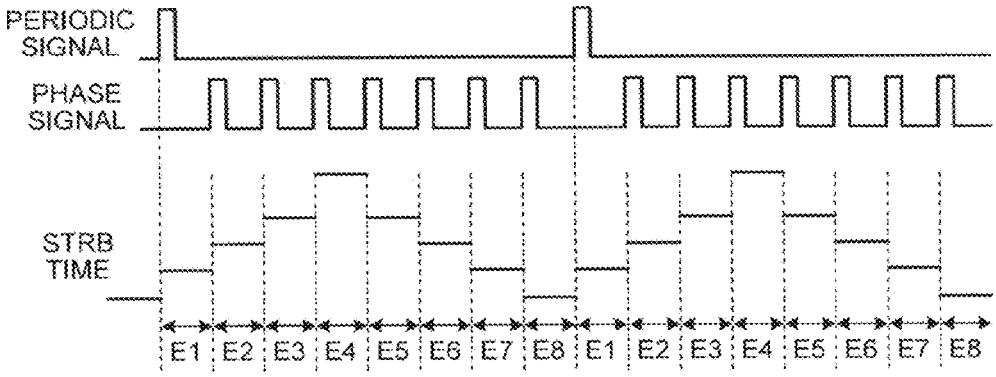
FIG. 12 is a timing chart illustrating another method for adjusting the light amount according to the embodiment.

When such a photosensitive drum 109 is used, the light emission time control unit 123 detects a phase signal that is a detection signal of the photosensitive element phase detection marker 119*b*, as well as the periodic signal that is a detection signal of the photosensitive element cycle detection marker 119*a*. Once the light emission time control unit 123 starts the control for the phase "E1" in response to a detection of the periodic signal, every time the phase signal is detected, the light emission time control unit 123 acquires the STRB time for the upcoming phase from the density variation correction value information illustrated in FIG. 10, and inputs the STRB time to the light emission control unit 122 as a control signal, as illustrated in FIG. 12. In this manner, the precise STRB time control at the same level as the method illustrated in FIG. 11 is performed based on the actual phase of the photosensitive drum 109.

In the manner described above, the optical writing device controller 120 according to the embodiment can correct density variation caused by the variation in the distance between the photosensitive drum 109 and the light source using a simple structure, and prevent deterioration of the image quality. At the same time, the STRB time can be controlled more precisely corresponding to the phase of the photosensitive drum 109.

Figure 13:
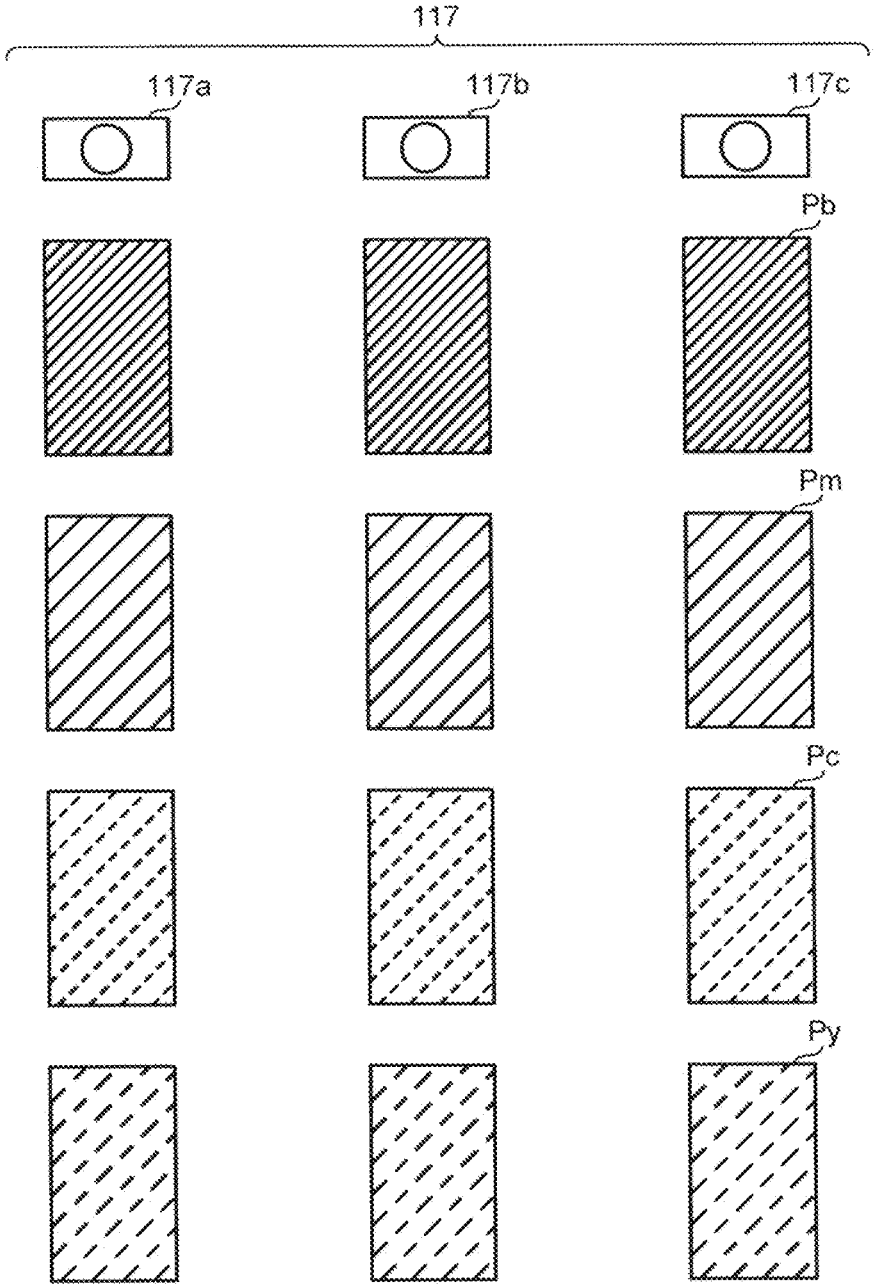
FIG. 13 is a schematic illustrating density variation detection patterns according to the embodiment, and a positional relationship between the density variation detection patterns and pattern detection sensors.

The density variation correction value information used for correcting the density variation caused by the variation in the distance between the photosensitive drum 109 and the light source, e.g., that illustrated in FIGS. 8 and 10, is generated based on density variation information obtained by drawing the density variation detection patterns such as that illustrated in FIG. 13 on the carriage belt 105, and reading the density variation detection patterns with the pattern detection sensors 117. In other words, in the embodiment, the density variation detection patterns illustrated in FIG. 13 are used as correction patterns.

As illustrated in FIG. 13, the density variation detection patterns include a pattern in each of the colors, that is, a black pattern Pb, a magenta pattern Pm, a cyan pattern Pc, and a yellow pattern Py (hereinafter, any one of the patterns is referred to as a density variation detection pattern P). The pattern in each of the colors is a pattern in a solid color developed across the circumference of each of the photosensitive drums 109BK, 109M, 109C, 109Y and then transferred onto the carriage belt 105. In other words, by reading the density of the density variation detection patterns P in each of the colors, a density variation corresponding to phases of a single rotation of each of the photosensitive drum 109 can be recognized.

As illustrated in FIG. 13, three of the pattern detection sensors 117 according to the embodiment are arranged in the main-scanning direction as pattern detection sensors 117*a*, 117*b*, 117*c*. The density variation detection patterns P according to the embodiment are then formed at positions corresponding to the respective pattern detection sensors 117 in the main-scanning direction. In this manner, the density variation detection patterns P can be read at a plurality of positions in the main-scanning direction. Therefore, not only the density variation in the sub-scanning direction, but also the density variation in the main-scanning direction can be obtained by calculations.

FIG. 14 is a schematic of density variation information generated by reading the density variation detection pattern as illustrated in FIG. 13. Stored in an associated manner in the density variation information according to the embodiment are a "phase" of the photosensitive drum 109 determined by detecting the photosensitive element cycle detection marker 119*a* or the photosensitive element cycle detection marker 119*a* and the photosensitive element phase detection markers 119*b* and the "density" generated by reading the density variation detection patterns P at each of the phases, as illustrated in FIG. 14.

The adjustment control unit 125 generates the density variation correction value information illustrated in FIGS. 8 and 10 based on the density variation information illustrated in FIG. 14. The process performed by the adjustment control unit 125 to achieve this goal is one of the essential features of the embodiment. To generate and to read the density variation detection patterns used in generating the density variation information illustrated in FIG. 14, and to generate density variation correction value information based on the density variation information illustrated in FIG. 14, the adjustment control unit 125 maintains the information illustrated in FIG. 15.

As illustrated in FIG. 15, the adjustment control unit 125 according to the embodiment maintains at least "reading timing count", "reading time count", and "detected density/correction value conversion parameters". The "reading timing count" is a count used in determining a timing at which the pattern detection sensors 117 are caused to start reading the density variation detection patterns P after the LEDA 281 starts exposing the photosensitive drum 109 and forming the density variation detection patterns. In other words, in the embodiment, the "reading timing count" is used as in formation indicating the time period from when the electrostatic latent images of the correction patterns are started being formed on the photosensitive drum to when the developed correction patterns reach respective reading positions where the correction patterns are optically read.

In the embodiment, the exposure performed to draw the density variation detection patterns P is started with reference to the periodic signal received from the phase detection sensor 118. In other words, when the counter initiated upon detecting the periodic signal for starting the exposure for drawing the density variation detection patterns reaches the "reading timing count", the pattern reading control unit 126 starts acquiring the detection signal from the pattern detection sensors 117.

The "reading time count" is a count representing time during which each of the black pattern Pb, the magenta pattern Pm, the cyan pattern Pc, and the yellow pattern Py illustrated in FIG. 13 is being read. In other words, the "reading time count" can also be said to be a count for measuring the time in which the photosensitive drum 109 is rotated one time. Therefore, in the embodiment, the "reading time count" is used as information indicating the time during which the developed correction patterns pass through the respective reading positions.

When the value of the counter started counting after the pattern reading control unit 126 starts acquiring the detection signal from the pattern detection sensors 117 with reference to the "reading timing count" reaches the "reading time count", the pattern reading control unit 126 ends acquiring the detection signal from the pattern detection sensors 117. In this manner, the pattern reading control unit 126 can acquire a signal resulting from reading the solid patterns drawn across the entire circumference of the photosensitive drum.

The "detected density/correction value conversion parameters" are information indicating parameters used in generating the density variation correction value information, such as that illustrated in FIG. 8 or 10, based on the density variation information, as illustrated in FIG. 14, that is generated by reading the correction patterns. Specific examples of the "detected density/correction value conversion parameters" will be described later.

Figure 16:
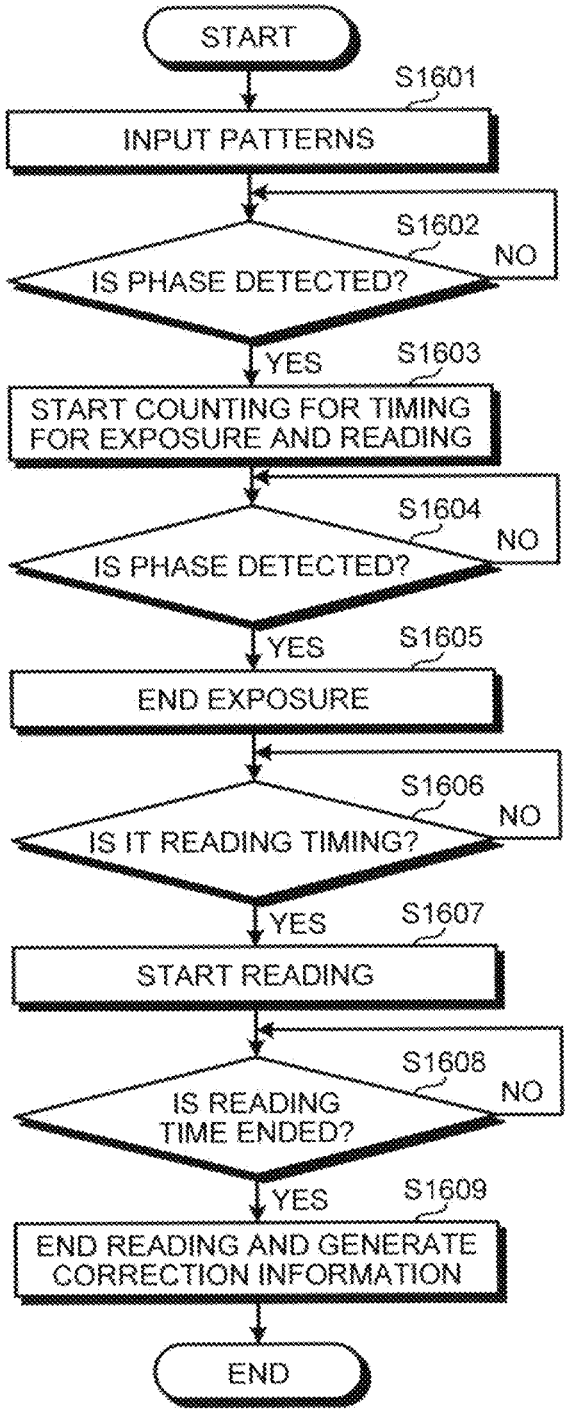
FIG. 16 is a flowchart illustrating a correction preparation operation according to the embodiment.

An operation from generation of the density variation detection patterns P according to the embodiment to generation of the density variation correction value information (hereinafter, referred to as a correction preparation operation) will now be explained. FIG. 16 is a flowchart illustrating the correction preparation operation according to the embodiment. In this embodiment, the correction preparation operation is performed at a timing of power-on reset (PoR) of the image forming apparatus 1 or at the timing the image forming apparatus 1 is resumed from the energy saving mode, or before an image forming output is made. The correction preparation operation according to the embodiment is performed when the adjustment control unit 125 determines that such an operation can be performed.

When the adjustment control unit 125 determines that the correction preparation operation can be performed and starts the operation, the pixel information representing patterns for forming the density variation detection patterns P illustrated in FIG. 13 is input to the line memory 121 (S1601). After the pixel information of the patterns is input to the line memory 121, if a periodic signal is received from the phase detection sensor 118 (Yes at S1602), the light emission control unit 122 controls exposure performed by the LEDA 281 based on the pixel information of the patterns stored in the line memory 121. At the same time, the pattern reading control unit 126 initiates the counter to determine the timing at which the pattern detection sensors 117 are caused to start reading the density variation detection patterns (hereinafter, referred to as a reading timing count) (S1603).

At this time, the number counted by the pattern reading control unit 126 is, for example, the actual time, the number of pulses of the motor that rotates the photosensitive drum 109, the number of a rotation detection signal that is output based on the rotation of the photosensitive drum 109, or the internal clock of the optical writing device controller 120. The "reading timing count" and the "reading time count" illustrated in FIG. 15 are set and stored in a manner suitable for each type of the count.

By causing the light emission control unit 122 to start exposing the photosensitive drums 109 and forming the density variation detection patterns P with reference to the periodic signal received from the phase detection sensor 118 at S1602 and S1603, the position on each of the photosensitive drums 109 on which the density variation detection patterns P are started being drawn can be synchronized. In this manner, a detection result of the density variation detection patterns P can be associated with a phase in the rotation of the photosensitive drums 109. In other words, while the light emission time control unit 123 functions as a rotational position recognizing unit during the actual image forming outputting operation, as mentioned above, the light emission control unit 122 functions as the rotational position recognizing unit at S1602.

After the light emission control unit 122 starts controlling the LEDA 281 to expose the photosensitive drums 109, if the periodic signal is received from the phase detection sensor 118 (Yes at S1604), in other words, if the photosensitive drum 109 is rotated one time after the exposure is started, the light emission control unit 122 ends exposing the photosensitive drums 109 (S1605).

When the reading timing count reaches the "reading timing count" explained with reference to FIG. 15 (Yes at S1606), the pattern reading control unit 126 starts acquiring the detection signal from the pattern detection sensors 117, and starts reading the density variation detection patterns (S1607). In other words, the pattern reading control unit 126 functions as a reading signal acquiring unit. The pattern reading control unit 126 acquires the detection signal from the pattern detection sensors 117 as density information, and stores the detection signal in the correction value information storage unit 124 at a predetermined reading cycle. In this manner, the density variation information illustrated in FIG. 14 is stored in the order of the phase "E1", "E2", "E3" . . . .

When the count after starting reading the density variation detection patterns reaches the "reading time count" explained with reference to FIG. 15 (Yes at S1608), the pattern reading control unit 126 ends acquiring the detection signal from the pattern detection sensors 117, and the adjustment control unit 125 generates the density variation correction value information illustrated in FIG. 8 or FIG. 10 based on the density variation information thus acquired as illustrated in FIG. 14 (S1609). At this time, the adjustment control unit 125 generates the density variation correction value information from the density variation information using the "detected density/correction value conversion parameters" explained with reference to FIG. 15. In other words, the adjustment control unit 125 functions as a correction value information generation control unit for generating the density variation correction value information as correction value information. In the process described above, the correction preparation operation according to the embodiment is completed.

Figure 17:
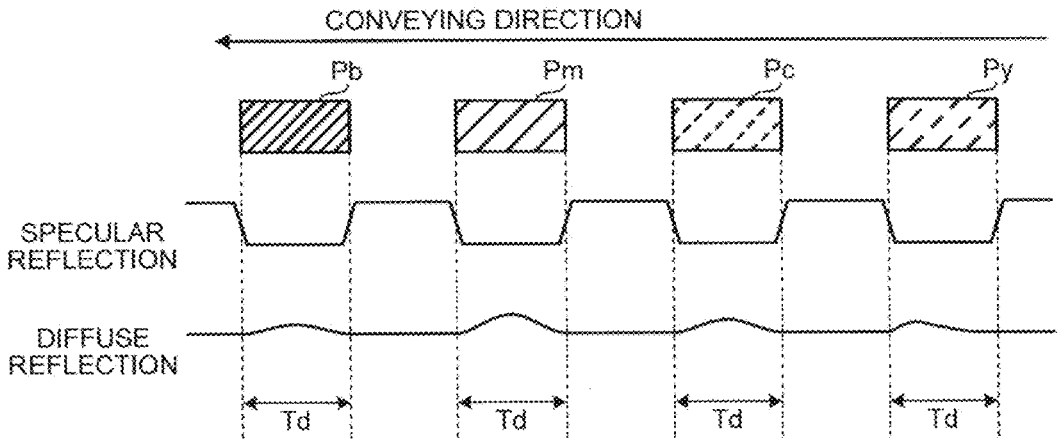
FIG. 17 is a timing chart illustrating timing at which a detection signal is acquired by a pattern reading control unit according to the embodiment.

In the example explained with reference to FIG. 16, the timing at which the pattern reading control unit 126 starts reading the density variation detection patterns P is determined with reference to the counter initiated when the LEDA 281 starts the exposure, through the processes at S1603 and S1606. Another example will now be explained with reference to FIG. 17. FIG. 17 is a schematic of an example in which the pattern reading control unit 126 determines the timing for starting reading the density variation detection patterns P based on the detection signal from the pattern detection sensors 117.

Specific types of photosensors that can be used as the pattern detection sensors 117 include sensors that detect specular reflection, and sensors that detect diffuse reflection. To acquire the density information as illustrated in FIG. 14, at least diffuse reflection needs to be detected. Therefore, photosensors that can detect diffuse reflection are used as the pattern detection sensors 117. By contrast, by detecting specular reflection, it becomes possible to directly determine that the density variation detection patterns have reached the respective detecting positions of the pattern detection sensors 117.

When the surface of the carriage belt 105 is black and glossy, the intensity of specular reflection becomes high in an area where the patterns are not formed on the surface of the carriage belt 105. By contrast, when a solid pattern in any of the colors of black, magenta, cyan, and yellow is detected, the detection signal of specular reflection drops from the level obtained for the belt surface, as illustrated in FIG. 17.

By using sensors that can detect both of specular reflection and diffuse reflection as the pattern detection sensors 117, each of the specular reflection detecting signal and the diffuse reflection detection signal can be input to the pattern reading control unit 126. In this manner, the pattern reading control unit 126 can make determination at S1606 illustrated in FIG. 16 using the timing at which the intensity of the detection signal of specular reflection drops. Furthermore, the pattern reading control unit 126 can make determination at S1608 illustrated in FIG. 16 based on the timing at which the intensity of the detection signal of specular reflection rises from the lower level. With this process, time Td for reading the density variation detection patterns P illustrated in FIG. 17 can be determined, and the same advantageous effects as those illustrated in FIG. 16 can be achieved.

Figure 18:
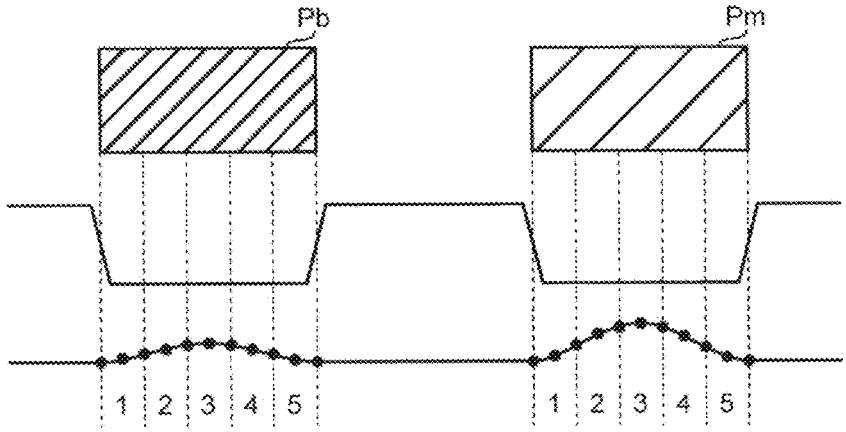
FIG. 18 is a schematic illustrating how the correction value information is generated according to the embodiment.

The correction information generating process at S1609 will now be explained in detail. In the example explained below, the "STRB time" is obtained for each of the phases, as illustrated in FIG. 10. FIG. 18 is a schematic illustrating the timing at which the density variation detection patterns P according to the embodiment are detected. FIG. 18 illustrates the black pattern Pb and the magenta pattern Pm as examples.

In the example illustrated in FIG. 18, the pattern reading control unit 126 acquires the detection signal from the pattern detection sensors 117 eleven times in the interval between the leading edge and the trailing edge of one of the patterns, e.g., the black pattern Pb or the magenta pattern Pm. In other words, in this embodiment, while one of the density variation detection patterns P passes through the detecting position of the corresponding pattern detection sensor 117, the pattern reading control unit 126 scans the density variation detection pattern P across the entire surface of the photosensitive drum 109 as the photosensitive drum 109 is rotated one time, by acquiring a plurality of reading signals at a given interval.

The adjustment control unit 125 divides the area between the leading edge to the trailing edge of the pattern into five sections, as illustrated in FIG. 18, based on the timing at which these eleven detection signals are detected, and generates detection data for each of these sections. In the example illustrated in FIG. 18, each of the density variation detection patterns P is divided into five sections in the sub-scanning direction. However, in the example illustrated in FIGS. 11 and 12, each of the density variation detection patterns P is divided into eight sections. The number in which the area is divided can be set accordingly to the cycle at which the correction is applied to the light amount.

For example, for the "section 1" illustrated in FIG. 18, the average of the first to the third detection data is calculated, and the average is used as the detection data for the "section 1". For the "section 2", the average of the third to the fifth detection data is used as the detection data of the "section 2". Each of the sections illustrated in FIG. 18 is used to divide the conveying direction of the carriage belt 105 into sections, and the direction corresponds to the rotating direction of the photosensitive drum 109. In other words, each of the sections illustrated in FIG. 18 corresponds to the "phase" illustrated in FIG. 10.

A method in which the detection data is generated for each of the sections is not limited to taking the average, and methods such as using a median of three values or using a median between the maximum value and the minimum value are also possible.

FIG. 19A illustrates an example of the detection data generated for each of the sections in the manner explained above. To generate the detection data, each of the sections is assigned with a voltage representing the detection data calculated by the adjustment control unit 125. The adjustment control unit 125 calculates an "ideal data ratio" using the detection data thus generated, which is illustrated in FIG. 19A, and ideal data stored as the "detected density/correction value conversion parameters", which is illustrated in FIG. 15, from Equation (1) below. The information in Equation (1) is also stored as the "detected density/correction value conversion parameters", in the same manner as the "ideal data".

$$\text{Ideal Data Ratio} = \frac{\text{Ideal Data}}{\text{Detected Data}} \times \frac{\text{Bias To Be Used In Actual Operation}}{\text{Bias Used In Pattern Formation}} \quad (1)$$

The "ideal data" in the Equation (1) is ideal density that should be detected from each of the density variation detection patterns P, and the ideal data ratio is a ratio of density. The "bias used in pattern formation" is a voltage of the bias applied to the photosensitive drum 109 when the density variation detection patterns P illustrated in FIG. 13 is formed. The "bias to be used in actual operation" in Equation (1) is a voltage of the bias to be applied to the photosensitive drum 109 in an operation of an image forming output to be performed after the adjustment currently being executed is completed.

Generally, the same voltage is used for the bias when the actual image forming output is made, and when the density variation detection patterns P are formed. However, as described earlier, the adjustment control unit 125 controls various adjustments in addition to this adjustment. This operation for adjusting the image density to an appropriate density by adjusting the voltage of the bias applied to the photosensitive drums 109 is positioned as one of the adjustments performed by the adjustment control unit 125.

If the adjustment control unit 125 performs the density adjusting operation before performing the density adjusting operation that is based on the phase of the photosensitive drum 109 according to the embodiment, the bias used in forming the density variation detection patterns P and the bias to be used in the actual image forming output may have a different voltage. To absorb the difference in the bias voltage, the adjustment control unit 125 multiplies the ratio between the "bias to be used in actual operation" and the "pattern used in pattern formation", as indicated in Equation (1). An example of the "ideal data ratio" generated for each of the sections as a result of calculating Equation (1) is illustrated in FIG. 19B.

Once the "ideal data ratio" is generated as illustrated in FIG. 19B, the adjustment control unit 125 multiples the "ideal data ratio" to the "default light emission time" for which the LEDA 281 emits light to each of the photosensitive drums 109, in the manner indicated by Equation (2) below, and converts the "section" into the "phase", to obtain the "STRB time" that is a corrected light emission time corresponding to the "phase", as illustrated in FIG. 19C.

$$\textit{STRB}\ \text{Time} = (\text{Default Light Emission Time}) \times (\text{Ideal Data Ratio}) \quad (2)$$

At this time, as indicated in Equation (2), in the embodiment, the "default light emission time" is used as information related to a reference light amount for causing the LEDA 281 to emit light. The adjustment control unit 125 generates the information of "STRB time" obtained for each of the "phases", as illustrated in FIG. 19C, as the correction information, and stores the information in the correction value information storage unit 124. In this manner, information in the same format as that illustrated in FIG. 10 can be obtained, and the process at S1609 illustrated in FIG. 16 is completed.

The adjustment control unit 125 can also generate the correction value information illustrated in FIG. 8 from the correction value information illustrated in FIG. 19C. The correction value information illustrated in FIG. 19C specifies the "STRB time" for each of the "phases", as illustrated in FIGS. 11 and 12. In other words, the correction value information illustrated in FIG. 8 can be obtained by converting the relationship between the "phase" and the "STRB time" illustrated in FIGS. 11 and 12 into the relationship illustrated in FIG. 9, that is, into a linear relationship.

A process of interpolating the correction values obtained as illustrated in FIG. 19C in the main-scanning direction will now be explained. In the embodiment, a plurality of pattern detection sensors 117*a*, 117*b*, 117*c* are arranged in the main-scanning direction, as illustrated in FIG. 13. Therefore, the density variation detection patterns P can be detected in each of these locations in the main-scanning direction. Thus, the correction values illustrated in FIG. 19C can be obtained for each of these locations in the main-scanning direction.

Figure 20A:
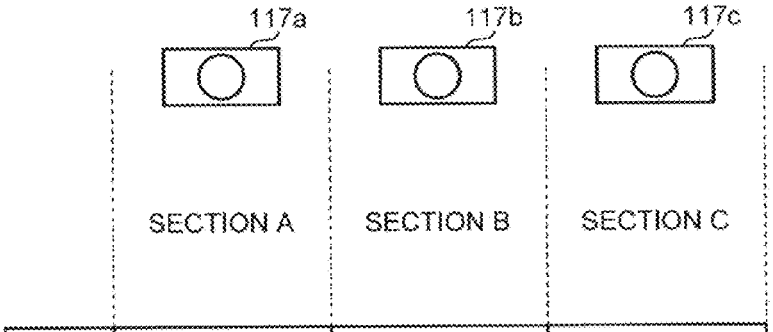
FIGS. 20A and 20B are schematics illustrating how correction value information is interpolated in the main-scanning direction in the embodiment.

FIG. 20A is a schematic illustrating how the correction values illustrated in FIG. 19C are generated for each of the locations in the main-scanning direction. In FIG. 20A, the area is divided into sections A, B, and C corresponding to the respective pattern detection sensors 117*a*, 117*b*, 117*c*, and the correction values obtained for each of the sections are used.

Figure 20B:
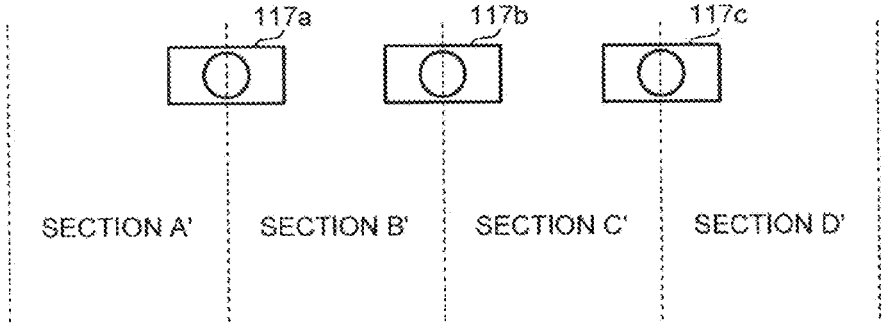

Any interpolation would not be required if the entire area in the main-scanning direction could be covered by the method illustrated in FIG. 20A. However, there are cases that the correction values need to be interpolated for the area outside of the pattern detection sensors 117*a* and 117*c*, for example, when all of the pattern detection sensors 117*a*, 117*b*, 117*c* are installed near the center of the main-scanning direction. FIG. 20B is a schematic illustrating a method of interpolating the correction values in such a case.

In the method illustrated in FIG. 20B, the position at which each of the pattern detection sensors 117 is installed is used as a boundary between these sections, and the correction values are interpolated for the areas outside of the pattern detection sensors 117*a* and 117*c* and the areas between the adjacent pattern detection sensors 117.

The density variation in the main-scanning direction occurs due to an error in the angle at which the photosensitive drum 109 or the LEDA 281 is mounted. In other words, the density variation in the main-scanning direction can be complemented by a linear interpolation. In the embodiment, the linear interpolation is applied in the main-scanning direction, based on the correction value obtained for each of the sections A, B, and C illustrated in FIG. 20A.

For example, the adjustment control unit 125 obtains the correction value for the section B' illustrated in FIG. 20B by obtaining the median between the correction value for the section A and the correction value for the section B illustrated in FIG. 20A. The adjustment control unit 125 also obtains the correction value for the section C' illustrated in FIG. 20B by obtaining the median between the correction value for the section B and the correction value for the section C illustrated in FIG. 20A.

The adjustment control unit 125 then obtains the difference between the correction value for the section B' and the correction value for the section C', and adds the difference to the correction value for the section B' and subtracts the difference from the correction value for the section C', to obtain the correction values for the areas A' and D', respectively. In the manner described above, with a simple linear interpolation, the correction value corresponding to each of the areas in the main-scanning direction can be interpolated. In other words, using a linear interpolation, density variation correction value information can be generated corresponding to each of the sections in the number larger than the number of the reading positions of the pattern detection sensors 117.

As described above, in the optical writing device according to the embodiment, the correction values for correcting the density variation caused by a variation in the distance between the photosensitive drum and the light source can be obtained using a simple structure.

In the example explained in the embodiment, the STRB time is directly specified in the correction value information, as illustrated in FIG. 19C. However, the present invention is not limited thereto, and a correction value for the default STRB time, that is, information about the difference may be specified for each of the "phases". In either case, the same effects can be achieved as long as the correction value information is the information for identifying the light amount used by the light emission control unit 122 in causing the LEDA 281 to emit light in a manner corresponding to the phase of the photosensitive drum 109, as information related to correction of the light amount.

Furthermore, in the embodiment, the STRB time of the LEDA 281 was explained to be a target of correction upon correcting the density variation. Alternatively, the density of the image ultimately formed may be adjusted by changing the voltage of the developing bias applied to the photosensitive drum 109. Therefore, the correction value information illustrated in FIG. 19C may be generated as information of the "voltage of the bias", instead of the information of the "STRB time", corresponding to the "phase" of the photosensitive drum 109.

Furthermore, in the example explained in the embodiment, a different light emission time is specified for each of the sections in the main-scanning direction, as illustrated in FIGS. 20A and 20B. However, the same light emission time may be specified across the entire area in the main-scanning direction, based on the correction value obtained in each of the sections as illustrated in FIG. 20A. In this manner, a different light emission time does not need to be specified for each of the sections in the main-scanning direction, and the configuration of the apparatus can be simplified. As a method for specifying the same light emission time across the entire area in the main-scanning direction based on the correction value obtained for each of the sections, an average, a median, a most-frequent value of the correction values obtained for the areas may be used.

According to the embodiment, a correction value can be obtained for addressing a variation of the distance between a photosensitive drum and a light source with a simple structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device, comprising:

a light source;

a first storage unit configured to sequentially store therein pieces of pixel information making up an image corresponding to main-scanning lines, respectively, the image being to be formed as an electrostatic latent image on a photosensitive element whose surface moves with respect to the light source by being rotated;

a light emission control unit configured to cause the light source to emit light on the basis of each of the pieces of pixel information stored in the first storage unit;

a rotational position recognizing unit configured to recognize a rotational position of the photosensitive element;

a second storage unit configured to store therein correction value information in which the rotational position of the photosensitive element and information about correction to an amount of light emitted by the light source are associated with each other;

a light amount control unit configured to control an amount of light emitted by the light source through the light emission control unit on the basis of the rotational position, by referring to the correction value information;

a reading signal acquiring unit configured to optically read an image that is formed by developing the electrostatic latent image and being conveyed to acquire a reading signal; and a correction value information generation control unit configured to generate the correction value information, wherein the light emission control unit causes the light source to emit light on the basis of the rotational position and pixel information making up a correction pattern to form an electrostatic latent image of the correction pattern on the photosensitive element, the correction pattern being formed across an entire circumference of the photosensitive element in a rotating direction and being used in generating the correction value information, the reading signal acquiring unit acquires reading signals resulting from reading the correction pattern that is formed by developing an electrostatic latent image of the correction pattern across the entire circumference of the photosensitive element in the rotating direction, generates, on the basis of the reading signals, density variation information in which a rotational position of the photosensitive element and a density of the correction pattern are associated with each other, and stores the density variation information in the second storage unit, the correction value information generation control unit generates information about correction to an amount of light emitted by the light source on the basis of the density of the correction pattern included in the density variation information to generate the correction value information and store the correction value information in the second storage unit, and the reading signal acquiring unit starts acquiring the reading signal on the basis of information indicating a time period from when the formation of the electrostatic latent image of the correction pattern on the photosensitive element is started to when the developed correction pattern reaches a reading position where the correction pattern is optically read.

2. The optical writing device according to claim 1, wherein the reading signal acquiring unit ends acquiring the reading signal on the basis of information indicating a time period during which the developed correction pattern passes through the reading position.

3. The optical writing device according to claim 1, wherein the reading signal acquiring unit acquires a reading signal of specular reflection and reading signals of diffuse reflection, determines that the correction pattern reaches the reading position where the correction pattern is optically read on the basis of the reading signal of specular reflection, and acquires the reading signals of diffuse reflection as the reading signals of the correction pattern.

4. The optical writing device according to claim 1, wherein the reading signal acquiring unit acquires the reading signals of the correction pattern at a given interval while the correction pattern passes through a reading position at which the correction pattern is optically read, and generates the density variation information in which rotational positions of the photosensitive element and densities of the correction pattern corresponding respectively to the rotational positions are associated with each other, the photosensitive element being divided into a plurality of sections each corresponding to the given interval by the rotational positions in the rotating direction.

5. The optical writing device according to claim 1, wherein the correction value information generation control unit calculates a density ratio that is a ratio between an ideal density of the correction pattern and a density of the correction pattern included in the density variation information, and generates the information about correction to an amount of light on the basis of the calculated density ratio and information about a reference amount of light emitted by the light source.

6. The optical writing device according to claim 5, wherein the correction value information generation control unit calculates a bias ratio that is a ratio between a bias voltage applied to the photosensitive element when the electrostatic latent image of the correction pattern is formed and a bias voltage to be applied to the photosensitive element when an image forming output is executed next time, and generates information about the correction to an amount of light on the basis of the density ratio and the calculated bias ratio and information about a reference amount of light emitted by the light source.

7. The optical writing device according to claim 1, wherein the light emission control unit forms an electrostatic latent image of each of a plurality of correction patterns on the photosensitive element in a main-scanning direction, the reading signal acquiring unit acquires reading signals corresponding respectively to the correction patterns formed by developing electrostatic latent images of the correction patterns, and generates the pieces of density variation information respectively for a plurality of positions in the main-scanning direction on the basis of the acquired reading signals, and the correction value information generation control unit generates pieces of correction value information corresponding respectively to a plurality of sections of an entire area of the photosensitive element in the main-scanning direction on the basis of the pieces of density variation information or the pieces of correction value information, the number of the plurality of sections is greater than the number of the plurality of positions.

8. An image forming apparatus comprising the optical writing device according to claim 1.

9. A correction value information generating method, comprising:

on the basis of pixel information making up a correction pattern formed across an entire circumference of a photosensitive element in a rotating direction, forming an electrostatic latent image of the correction pattern on the photosensitive element by causing a light source to emit light on the basis of on a rotational position of the photosensitive element;

acquiring reading signals resulting from reading the correction pattern that is formed by developing the electrostatic latent image of the correction pattern across the entire circumference of the photosensitive element in the rotating direction;

generating, on the basis of the reading signals, density variation information in which a rotational position of the photosensitive element and a density of the correction pattern are associated with each other;

generating information about correction to an amount of light emitted by the light source on the basis of the density of the correction pattern included in the generated density variation information; and generating correction value information in which the rotational position of the photosensitive element and the information about correction to an amount of light are associated with each other, wherein:

during the forming of the electrostatic latent image, the light source emits light on the basis of the rotational position and pixel information making up a correction pattern to form an electrostatic latent image of the correction pattern on the photosensitive element, the correction pattern being formed across an entire circumference of the photosensitive element in a rotating direction and being used in generating the correction value information, the acquiring acquires reading signals resulting from reading the correction pattern that is formed by developing an electrostatic latent image of the correction pattern across the entire circumference of the photosensitive element in the rotating direction, generates, on the basis of the reading signals, density variation information in which a rotational position of the photosensitive element and a density of the correction pattern are associated with each other, and stores the density variation information, the generating of correction value information generates information about correction to an amount of light emitted by the light source on the basis of the density of the correction pattern included in the density variation information thus generated to generate the correction value information and store the correction value information, and the acquiring starts acquiring the reading signals on the basis of information indicating a time period from when the formation of the electrostatic latent image of the correction pattern on the photosensitive element is started to when the developed correction pattern reaches a reading position where the correction pattern is optically read.

* * * * *